United States Patent [19]

Gough

[11] Patent Number: 4,595,155

[45] Date of Patent: Jun. 17, 1986

[54] NET RETRACTOR

[75] Inventor: Stephen J. Gough, Christies Beach, Australia

[73] Assignee: John Gough, Port Noarlunga, Australia

[21] Appl. No.: 660,582

[22] Filed: Oct. 15, 1984

[51] Int. Cl.[4] ..... E04B 17/02; A63B 61/04

[52] U.S. Cl. ..... 242/848; 273/29 BD; 273/29 BE

[58] Field of Search ..... 273/29 B, 29 BD, 29 BE, 273/29 BF, 29 BG; 242/84.8, 106

[56] References Cited

U.S. PATENT DOCUMENTS

| | | | |
|---|---|---|---|
| 906,848 | 12/1908 | Atwell | 273/29 BG |
| 1,300,972 | 4/1919 | Janssen | 273/29 BG |
| 1,526,126 | 2/1925 | Fitzherbert | 273/29 BF |
| 3,186,657 | 6/1965 | Roe | 242/84.8 |
| 4,065,099 | 12/1977 | Germain | 273/29 BE |
| 4,119,301 | 10/1978 | Payne | 273/29 BD |

FOREIGN PATENT DOCUMENTS

| | | | |
|---|---|---|---|
| 5819 | of 1907 | United Kingdom | 273/29 BG |
| 3954 | of 1908 | United Kingdom | 273/29 BD |

*Primary Examiner*—Stuart S. Levy
*Assistant Examiner*—Lloyd D. Doigan

[57] ABSTRACT

A drum which is rotatable within a housing having a "C" shaped cross-sectional shape which defines a net access opening, the drum being rotatable by means of a handle. A ratchet wheel and pawl arrangement can be released to allow a net wound on the drum to be extended, or engaged to allow tightening of the net. The access opening can be closed for storing the net.

6 Claims, 3 Drawing Figures

NET RETRACTOR

This invention relates to a net retractor which is suitable for retracting a sporting net, for example a tennis net.

As presently used, tennis nets are cumbersome to erect and to store, and the object of this invention is to provide a retractor which can store a tennis net in its retracted position, but allow the net to be extended across a tennis court, and subsequently to be tightened to the correct height. Although the invention is specifically described with respect to a tennis net, it will be quite clear to those in the art that the invention is equally applicable to other sporting nets, for example badminton nets.

BACKGROUND OF THE INVENTION

There is a recognised need to store a tennis (or other sporting) net adjacent a tennis court, and also to lock it in a housing both for security reasons and to limit degradation due to weathering, etc. The closest art to the present invention which is known to the Applicant is the old U.S. Pat. No. 1,526,126 (Fitzherbert) but that patent did not disclose closure means, nor ratchet means which enabled the net to be tightened to the correct height after having been extended across a tennis court. The reader may also refer to Swedish Pat. No. 7710460-2 and French Pat. No. 2495944 for disclosure of different types of devices.

BRIEF SUMMARY OF THE INVENTION

In one embodiment of the invention there is provided a drum which is rotatable within a housing having a "C" shaped cross-sectional shape which defines a net access opening, the drum being rotatable by means of a handle. A ratchet wheel and pawl arrangement can be released to allow a net wound on the drum to be extended, or engaged to allow tightening of the net. The access opening can be closed for storing the net.

More specifically, in this invention, a net retractor for a sporting net comprises a base, a cover, a housing extending between the base and cover, the housing having a "C" shaped cross-sectional shape defining a net access opening, a drum journalled for rotation within the housing, a handle external of the housing and coupled to the drum for effecting rotation thereof, a ratchet on the drum and a ratchet pawl carried by the housing and co-operable with the ratchet for limiting rotation to one direction only, retention means carried by the housing and effective in retaining the ratchet pawl in a release position, and closure means on the housing positionable at least partly across the access opening.

An embodiment of the invention is described hereunder in some detail with reference to, and is illustrated, in the accompanying drawings, in which.

Figure 1:
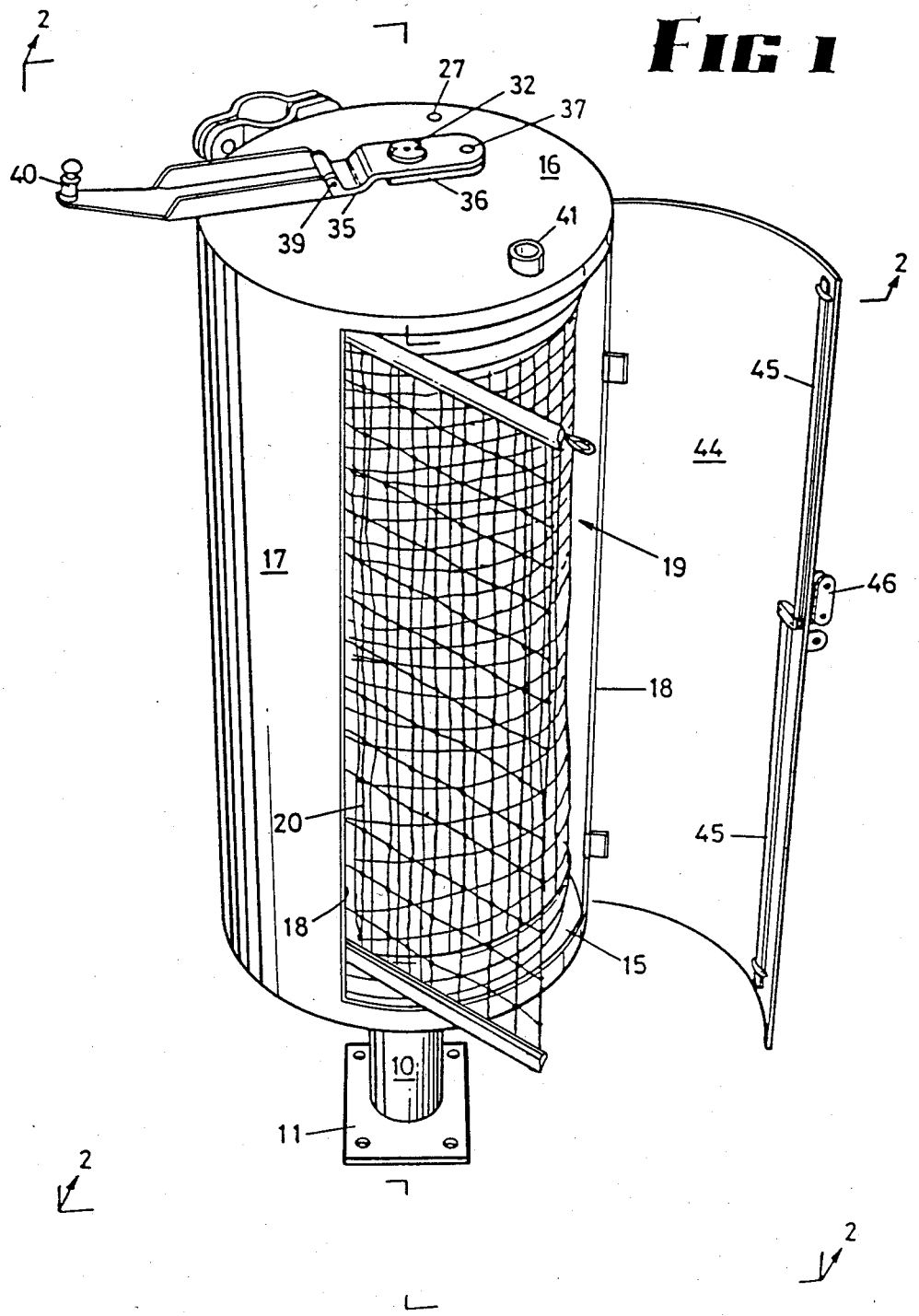
FIG. 1 is a perspective view of a net retractor.

In this embodiment there is provided a central post 10 secured to a ground engaging member 11, the post 10 being a metal tube projecting a short distance above the ground. The upper end of the post 10 supports a bush 12 (or other bearing), in which is journalled a short shaft 13 depending from a drum 14.

The upper end of the post 10 supports a dish-like base 15, and there is also provided a cover 16. Between the cover 16 and base 15 is a "C" shaped housing 17, the edges 18 of the housing defining an access opening 19 for a net 20 when wound around drum 14. The upper end of drum 14 has an upwardly extending shaft 22 journalled in an upper bearing 23 which is in cover 16.

Figure 3:
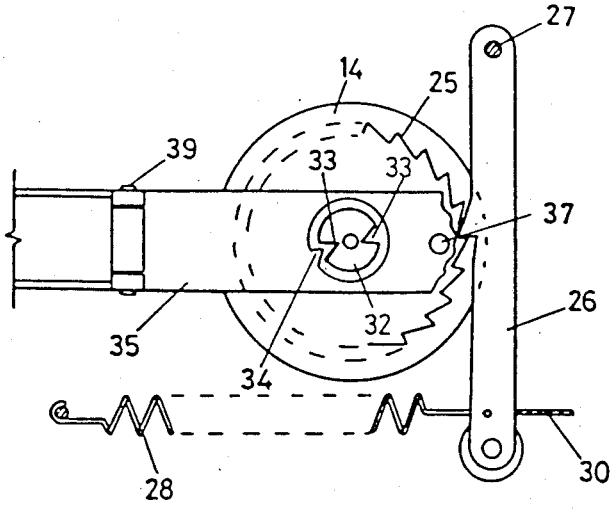
FIG. 3 is a diagrammatic plan which illustrates the handle and ratchet arrangement.

As shown best in FIG. 3, the upper end of drum 14 carries on it a ratchet wheel 25 which is engaged by pawl 26, pivoted at its rear end to cover 16 by pivot pin 27, and drawn into engagement by spring 28. The pawl however is movable to a release position, away from wheel 25, and can be retained in that position by engagement with toothed plate 30 depending from the under surface of cover 16. (A mechanical equivalent of the pawl may be used).

Figure 2:
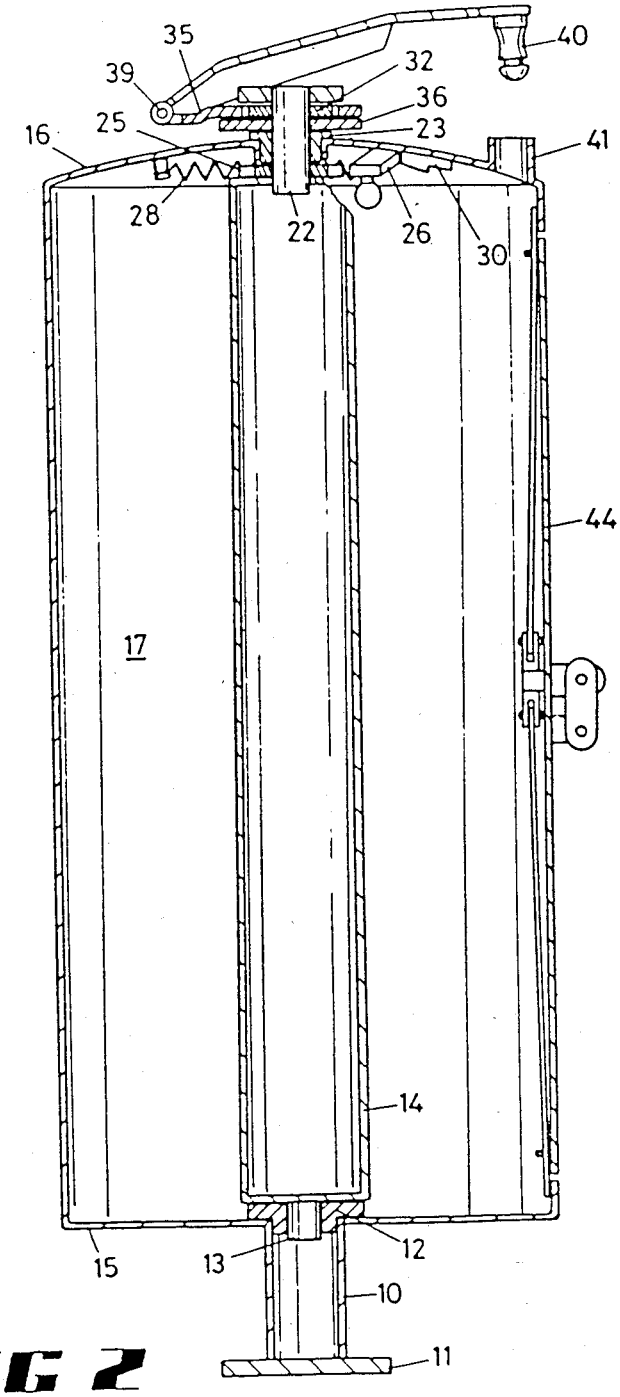
FIG. 2 is a section taken on the orthogonal planes indicated by the arrows 2-2-2-2 of FIG. 1.

Near its upper end, shaft 22 has secured on it an abutment plate 32 having at least one, and in this embodiment, a pair of abutment surfaces 33 thereon. These are selectively engageable by a complementary abutment surface 34 on a handle 35 upon pivotal movement of the handle in a clockwise direction with respect to a support plate 36 (which itself is itself rotatable on shaft 25,) about a pivot pin 37. As shown in FIGS. 2 and 3, the aperture in the handle 35 which accommodates plate 32 is "oversize" to allow the pivotal movement of the handle into or out of its engagement with an abutment surface 33. Uppermost washer-like retaining member 38 retains handle 32 against axial displacement away from shaft 22. Handle 35 is provided with an intermediate hinge 39 by which it can be folded, with its knob 40 entering a nesting bush 41 in cover 16 When pawl 26 is in its release position, shaft 22 is freely rotatable in each direction of rotation, but if handle 35 is rotated in a net tightening direction (clockwise in FIG. 3), it firstly pivots about pin 37 until abutment surface 34 abuts one of surfaces 33, whereupon further clockwise movement will cause rotation of drum 14 and tightening of net 20, which will be retained by pawl 26 when in the position where it co-operates with ratchet wheel 25 (FIG. 3).

The access opening 19 may be closed against theft or vandalism, or weathering of the net, by a closure member 44, and locked by locking bars 45 movable by handle 46, and retained closed by lock means, for example, a padlock.

In use, a net 20 is wound around the rotating drum 14, and the end of the net is retracted into the drum. In some embodiments it can protrude through the access opening in the housing. When it is required to extend the net to another net post, this is achieved by releasing the ratchet pawl and the net drum is then freely rotatable. After the net has been engaged on anchor means on the opposite net post, the handle is rotated with the ratchet pawl in position to prevent extension, the net being moved in a retracting direction. This will tighten the net until the correct height is reached. When the net is to be retracted, the ratchet pawl is again released, the net is removed from the second net post and the handle operated to retract the net into the housing.

A consideration of the above embodiment will indicate that the invention is exceptionally simple. However it provides a satisfactory net storage means, a means whereby a net can be quickly and easily stretched between posts and tightened, and whereby it can be easily retracted. The handle may if desired be permanent but in the above described embodiment the handle is removable, this being a valuable "vandal-proof" facility.

I claim:

1. A net retractor for a sporting net, comprising a base, a cover, a housing extending between the base and cover, the housing having a "C" shaped cross-sectional shape defining a net access opening, a drum journalled for rotation within the housing, a handle external of the housing and coupled to the drum for effecting rotation thereof, a ratchet on the drum and a ratchet pawl carried by the housing and engageable with the ratchet for limiting rotation to one direction only a spring co-operatively coupling the pawl and housing urging said ratchet into engagement with said pawl, retention means carried by the housing engageable by said pawl to be effective in retaining the ratchet pawl in a release position when moved into engagement with said retention means said ratchet and ratchet pawl are contained within the housing and above the upper end of the drum, closure means on the housing positionable at least partly across the access opening, a bearing in the lower end of the housing carried by the base and a bearing in the upper end of the housing carried by the cover, said drum having a depending shaft journalled for rotation in the first said bearing and an upwardly extending shaft projecting through the cover and journalled for rotation in the second said bearing, said pawl wheel surrounding and secured with respect to the upwardly extending shaft, and an abutment plate near the upper end of said upwardly extending shaft having an abutment surface thereon, a support plate between the abutment plate and the housing cover itself rotatable on the upwardly extending shaft, and a pivot pin joining the abutment plate to the handle, a complementary abutment surface on the handle which engages said abutment surface on the abutment plate be pivotal movement of the handle about said pivot pin upon rotation of the handle in a net retracting direction.

2. A net retractor according to claim 1 wherein said closure means comprises a closure member, hinge means joining the closure member to the housing, and lock means between the cover and the housing arranged to lock the cover in a closed position over the access opening.

3. A net retractor according to claim 1 wherein said handle comprises a hinge intermediate its ends arranged so that the handle is foldable.

4. A net retractor for a sporting net, comprising a base, a cover, a housing extending between the base and cover, the housing having a "C" shaped cross-sectional shape defining a net access opening, a drum journalled for rotation within the housing, a handle external of the housing and coupled to the drum for effecting rotation thereof, a ratchet on the drum and a ratchet pawl carried by the housing and engageable with the ratchet for limiting rotation to one direction only a spring co-operatively coupling the pawl and housing urging said ratchet into engagement with said pawl, retention means carried by the housing engageable by said pawl to be effective in retaining the ratchet pawl in a release position when moved into engagement with said retention means, closure means on the housing positionable at least partly across the access opening, a bearing in the lower end of the housing carried by the base and a bearing in the upper end of the housing carried by the cover, said drum having a depending shaft journalled for rotation in the first said bearing and an upwardly extending shaft projecting through the cover and journalled for rotation in the second said bearing, said pawl wheel surrounding and secured with respect to the upwardly extending shaft, and an abutment plate near the upper end of said upwardly extending shaft having an abutment surface thereon, a support plate between the abutment plate and the housing cover itself rotatable on the upwardly extending shaft, and a pivot pin joining the abutment plate to the handle, a complementary abutment surface on the handle which engages said abutment surface on the abutment plate by pivotal movement of the handle about said pivot pin upon rotation of the handle in a net retraction direction.

5. A net retractor according to claim 4 wherein said closure means comprises a closure member, hinge means joining the closure member to the housing, and lock means between the cover and the housing arranged to lock the cover in a closed position over the access opening.

6. A net retractor according to claim 1 wherein said handle comprises a hinge intermediate its ends arranged so that the handle is foldable.

* * * * *